US005935411A

United States Patent [19]

Brown et al.

[11] Patent Number: 5,935,411

[45] Date of Patent: Aug. 10, 1999

[54] CONTINUOUS PROCESS FOR ELECTROPOLISHING SURGICAL NEEDLES

[75] Inventors: Robert Brown; Gordon Stuart, both of Edinburg, United Kingdom; Geoffrey DeYoung, Pittstown, N.J.; Andrew John Schuessler, Trenton, N.J.; George Schob, Princeton Junction, N.J.; Mufutau G. Olatunji, Buford, Ga.; Eugene Reynolds, Freehold, N.J.

[73] Assignee: Ethicon, Inc., Somerville, N.J.

[21] Appl. No.: 08/857,662

[22] Filed: May 16, 1997

[51] Int. Cl.[6] ..... C25F 3/00; C25F 7/00

[52] U.S. Cl. ..... 205/672

[58] Field of Search ..... 205/640, 660, 205/672, 673, 682, 219

[56] References Cited

U.S. PATENT DOCUMENTS

| | | | |
|---|---|---|---|
| 2,348,517 | 5/1944 | Beckwith | 204/140 |
| 2,386,078 | 10/1945 | Welsberg et al. | 204/140 |
| 2,607,724 | 8/1952 | Laing | 204/206 |
| 2,740,755 | 4/1956 | Couch et al. | 204/140.5 |
| 2,773,821 | 12/1956 | Smith | 204/140.5 |
| 3,268,428 | 8/1966 | Buccino | 204/142 |
| 3,701,725 | 10/1972 | Beruff et al. | 204/297 |
| 3,703,452 | 11/1972 | Beroff et al. | 204/129.1 |
| 3,707,452 | 12/1972 | Lester et al. | 204/192 |
| 4,335,718 | 6/1982 | Calandrese | 128/218 |
| 4,777,096 | 10/1988 | Borysko . | |
| 5,258,013 | 11/1993 | Granger et al. | 606/223 |
| 5,352,378 | 10/1994 | Mathisen et al. | 252/54 |
| 5,456,948 | 10/1995 | Mathisen et al. | 427/387 |
| 5,458,616 | 10/1995 | Granger et al. | 606/223 |
| 5,477,604 | 12/1995 | Smith et al. | 29/558 |

FOREIGN PATENT DOCUMENTS

| | | |
|---|---|---|
| 0 650 698 A1 | 5/1995 | European Pat. Off. . |
| 0 627 474 A1 | 12/1995 | European Pat. Off. . |
| 1051230 | 8/1987 | Japan . |
| 1051230 | 2/1989 | Japan . |
| 3055129 | 7/1989 | Japan . |
| 3055129 | 3/1991 | Japan . |
| 242634 | 9/1969 | Russian Federation . |
| 1530405 | 12/1989 | Russian Federation . |
| 242634 | 9/1969 | U.S.S.R. . |
| 1530405 | 12/1989 | U.S.S.R. . |
| 1192656 | 2/1969 | United Kingdom . |

*Primary Examiner*—Kathryn Gorgos
*Assistant Examiner*—Edna Wong
*Attorney, Agent, or Firm*—Emil Richard Skula

[57] ABSTRACT

A continuous process for electropolishing surgical needles. Surgical needles are mounted to an electrically conductive carrier strip. The carrier strip and needles are then moved continuously through an electropolishing bath and the needles are maintained in the bath for a sufficient period of time to effectively polish the needles.

3 Claims, 4 Drawing Sheets

CONTINUOUS PROCESS FOR ELECTROPOLISHING SURGICAL NEEDLES

TECHNICAL FIELD

The field of art to which this invention relates is electropolishing processes, more specifically, processes for electropolishing surgical needles.

BACKGROUND OF THE INVENTION

Processes and equipment for manufacturing surgical needles are well known in the art. Conventionally, wire on spools is straightened and cut into needle blanks. The needle blanks are then subjected to a series of conventional grinding, forming, shaping and drilling steps to form surgical needles having distal piercing points and proximal suture mounting ends. The distal ends of the needles may be either of the taper point type or the cutting edge type. The suture mounting end may have a formed channel or a drilled hole. The needles may be straight or curved. The piercing points may be sharp or blunt.

Conventional needle manufacturing equipment and processes are disclosed in European Patent Application Publication No. EP 650698 and U.S. Pat. No. 5,477,604 which are incorporated by reference.

It is typically required that conventional surgical needles have a smooth surface free from burrs, protrusions, machining marks, and other known surface irregularities. Such protrusions or surface irregularities may result from the needle manufacturing process. It can be appreciated by those skilled in the art that such protrusions or surface irregularities must be removed from a needle in order to have a needle with a smooth surface. It is believed that a smooth needle surface provides minimal tissue drag and decreased tissue trauma. In order to provide a needle free from protrusions and surface irregularities, it is known in the art to electropolish surgical needles. Electropolishing processes and an apparatus for electropolishing drilled surgical needles are disclosed in U.S. Pat. Nos. 3,707,452 and 3,701,725 which are incorporated by reference. A continuous electropolishing method is disclosed in U.S. Pat. No. 5,477,604.

In a conventional electropolishing process, a plurality of metal parts, e.g., surgical needles, is immersed in an aqueous bath containing an electrolyte such as acid and water, e.g., phosphoric acid and water. The bath typically is contained in a conventional, non-conductive vessel having a sufficient capacity to effectively contain the bath and metal parts. Two electrodes of opposite polarity are immersed in the bath and a current is conducted from the anodic electrode, through the metal parts and to cathodic electrode. The metal parts are typically in direct physical contact with the anodic electrode. The passage of current through the bath results in the removal of metal from the exterior surfaces of the metal parts, especially at sharp surfaces or irregular surfaces.

It is known in electrochemical processes that heating the electrochemical bath may facilitate the metal removal process. It is also typical to have some sort of mechanical agitation or circulation of the electropolishing bath. The pattern of metal removal in an electrochemical process is believed to be a function of several factors, including contact with the anode and/or other metal parts, orientation with respect to the cathode, and the configurations of the cathode. It is also believed that the activity of metal removal is affected by the specific gravity and "freshness" of the electropolishing bath.

Metal removal in an electropolishing process is believed to be caused by a known electrochemical reaction.

Specifically, acid components, and some components of the metal have an affinity for each other. This is further enhanced by the current flow through the bath. As the metal is removed from the parts, a film is formed at the exterior surface of the parts. This film is believed to consist of a viscous liquid, which is saturated with the dissolution products of the metal, and a blanket of anodically discharged gas, typically oxygen. It is believed that this film does not perfectly conform to the exterior surfaces of part. Instead of following the micro-roughness, it tends to conform to the exterior macro-contour. Therefore the film is effectively thinner over small projections and thicker over depressions. Since there is correspondingly less resistance at the projections, more current is allowed to flow at those locations causing more intense localized polishing. This is believed to be one explanation of how surface roughness is smoothed during electrochemical polishing. It is also believed that temperature has an effect on the reaction rate, and, therefore, on the amount of metal removal. Typically, it is known to heat the electrolyte to some optimal temperature, for any particular electrolyte bath and surgical needle combination, for the desired metal removal rate.

Although the electropolishing processes of the prior art for surgical needles are adequate, there are certain disadvantages attendant with their use. Most conventional electropolishing processes are batch processes. In typical batch process, mechanical damage to the needles may result from the needles coming into contact with each other during handling and processing. Another disadvantage is that the metal removal rate is highly variable. For example, the suture mounting ends of the needle may experience excessive, detrimental metal removal. It is presently not possible to polish specific sections of a needle without polishing the entire needle. Another disadvantage is that the needles may experience different removal rates depending on their location within the bath with respect to the electrodes and with respect to the other needles. Yet another disadvantage is that metal removal rate may be affected in an adverse manner when needles contact each other in an electrochemical polishing bath.

There is continuing need in this art for improved electropolishing processes for surgical needles which would overcome these disadvantages.

Therefore, it is an object of the present invention to provide a novel continuous electropolishing process.

It is a further object of the present invention to provide an electropolishing process which allows the polishing of individual sections of a needle.

It is still another object of the present invention to provide an electropolishing process which provides reproducible, uniform metal removal.

Still yet another object of the present invention is to provide an electropolishing process which minimizes mechanical damage to surgical needles during processing.

Accordingly, a novel continuous process for electropolishing surgical needles is disclosed. In this process, surgical needles are mounted to a conductive carrier strip. The conductive carrier strip and needles are connected to an anodic electrode. The carrier strip moves the needles through an electropolishing bath contained in a vessel having a cathodic electrode therein so that at least a section of each needle is immersed and moved through the electropolishing bath. A current is passed between the anodic electrode, through the carrier and needles and to the cathodic electrode such that metal is removed from the exterior surfaces of the sections of the needles immersed in the bath.

In particular, surface roughness is removed producing needles having smooth surfaces. The strip mounted polished needles are then moved out of the electropolishing bath.

Yet another aspect of the present invention is the above-described electropolishing process wherein the bath is caused to flow such that the direction of flow is 180 degrees opposite to the direction of movement of the carrier strip and needles for at least one half of the movement of the needles through the bath.

Still yet another aspect of the process of the present invention is the above-described electropolishing process wherein the bath is contained in a vessel having opposed end walls with an entrance opening in one end wall for the carrier strip and needles to enter the bath and an exit opening on the other end wall to allow the carrier strip and needles to exit the bath. The exit and entrance openings have bottoms and the level of the bath in the vessel is above the bottoms of the openings.

There are numerous advantages associated with the process of the present invention. First of all, it is now possible to electropolish surgical needles in an electropolishing process wherein the amount of metal removal on each needle is substantially constant for each needle processed through the bath. In addition, needles can be continuously electropolished without having individual needles contact each other since the needles are individually mounted to a carrier strip.

It is now possible using the process of the present invention to isolate the electropolishing to certain sections of the needles, thereby eliminating metal removal from sections in which it is not desired.

Other features and advantages of the invention will become more apparent from the following description and accompanying drawings.

DESCRIPTION OF PREFERRED EMBODIMENTS

Figure 1:
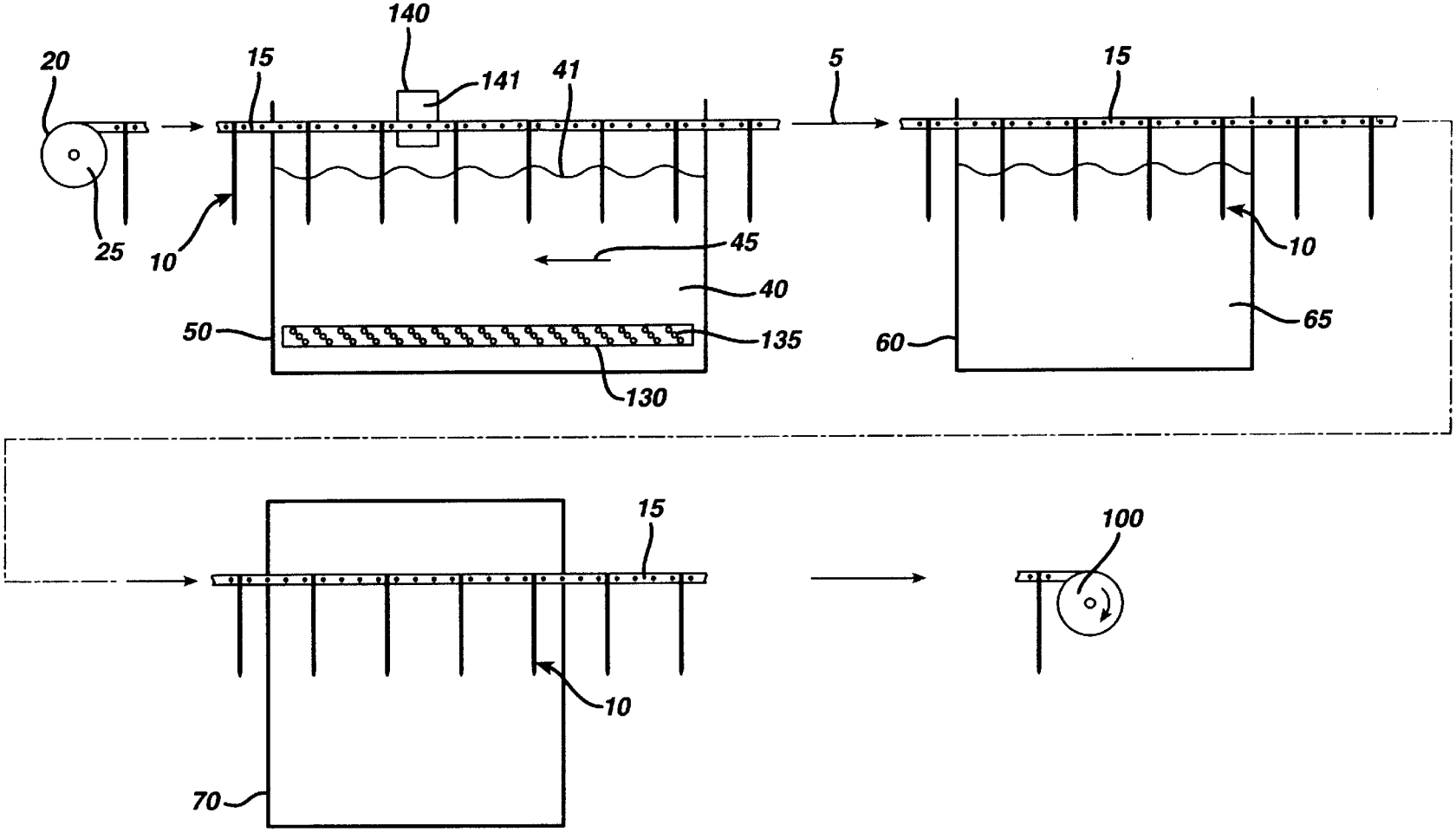
FIG. 1 is a schematic diagram for a process of the present invention.

A typical electrochemical polishing or metal removal process consists of the steps of submersing a metallic surgical needle into a vessel containing a bath of an electrolyte solution, for example, an acid/water solution. The needles are polished in the bath by applying a direct current across the needles. The current may be applied in such a manner that the amperage is preset and maintained and voltage is allowed to fluctuate with resistance. This is referred to as "current control". It is also known that a direct current can be applied with a preset and maintained voltage. When using a preset voltage the current may be allowed to fluctuate. This is known as "voltage control".

In a conventional current-controlled electropolishing process used for surgical needles, the current must be applied through the needles and the acid solution in order to remove metal from the surface of the needles electrochemically. Therefore, it is necessary that the needles be in contact with a conductor. It is known in the art in batch processes to utilize a carrier such as a metal basket having a small weave to suspend surgical needles in an electrochemical bath wherein the basket is connected to an electrical source as an anode (positively charged). The needles are in contact with the anodic metal basket. Current will then flow through the metal basket, the needles, and the acid solution to the cathode (negatively charged). During the electrochemical polishing process, metal is removed from the exterior surface of the needles and at least a portion of the metal is deposited onto the surface of the cathode. In addition, a portion of the metal remains in the acid solution and yet another portion of the metal combines chemically with the components of the acid. Preferably the carrier is constructed out of material which is acid resistant. The cathode similarly needs to be acid resistant although the metal removed from the needles will plate the exterior surfaces of the cathode.

It is desirable that the vessel or tank holding the electropolishing bath be constructed from conventional non-conducting materials such as polypropylene, CPVC, or other suitable materials. Although not preferred, the vessel may be made from a conductive metal and the vessel could then be wired to serve as either the anode or the cathode.

It is also known that heating an electrochemical bath may accelerate the metal removal process. In addition, it is typical to have some sort of mechanical agitation or circulation of the electropolishing bath for several reasons, i.e., to prevent areas of low reaction activity. The rate of metal removal in an electrochemical process is believed to be a function of needle contact, orientation with respect to the cathode, contact with the anode, and the configurations of the cathode and anode. It is also known that the degree of metal removal is a function of the specific gravity and "freshness" of the electropolishing bath. In addition, the configuration of the needle will affect metal removal.

Figure 2A:
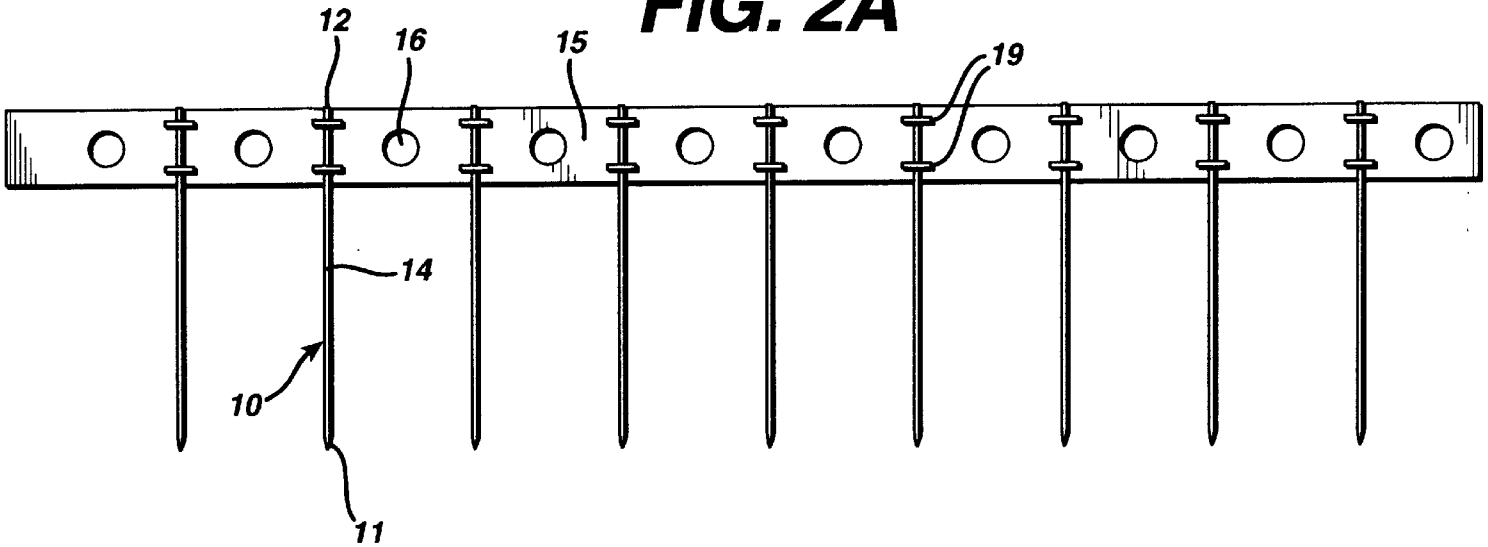
FIG. 2A is a partial view of a section of conductive carrier strip having straight needles mounted thereto.
Figure 2B:
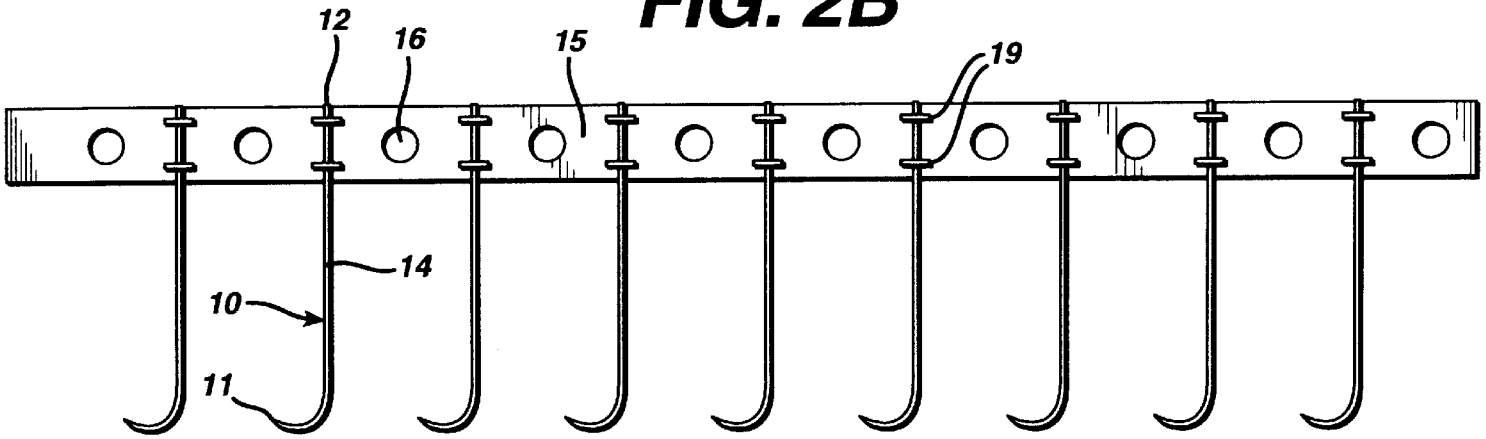
FIG. 2B is a partial view of a section of conductive carrier strip having curved needles mounted thereto.

Referring now to FIG. 1, a schematic diagram of the process of the present invention is illustrated. As seen in FIG. 1, needles 10 are mounted to a carrier strip 15 having tabs 19 for holding the needles 10 to strip 15. The needles 10 may be mounted to the strip 15 in various ways including crimping or clamping of the carrier material to the wire blank, crimping or clamping of the wire blank to the carrier, using mechanical fasteners which could couple the wire and carrier, and the like and equivalents thereof (See FIGS. 2A and 2B). Typically, the mounting of the needles to the carrier strip 15 is done as part of the needle manufacturing process, for example, as disclosed in U.S. Pat. No. 5,477,604. The needles 10 may be straight as illustrated in FIG. 2A or curved as illustrated in FIG. 2B. The needles 10 have bodies 14, distal piercing points 11 and proximal suture mounting ends 12. Strip-mounted needles exiting such a manufacturing process are typically coiled on a conventional spool by a conventional winding machine.

To initiate the process of the present invention, a coil 25 of needles 10 mounted to strip 15 is mounted to a conventional dancer arm controlled, de-coiling machine 20 adjacent to electropolishing vessel 50. It is preferable that the carrier strip 15 and needles 10 be directly routed to the electropolishing process of the present invention after exiting the needle manufacturing process, thereby making the need to re-coil and then decoil from the coil 25 optional.

Carrier strip 15 and needles 10 are then directed from optional decoiler 20 to the electropolishing bath 40 contained in vessel 50. The needles 10 are moved through bath 40 by carrier strip 15 which is electrically contacted to serve as an anode. A cathode 130 is immersed in the bath 40. The strip 15 and needles 10 are moved in direction 5. The needles 10 remain in bath 40 for a sufficient time to effectively remove the desired amount of metal. The relative movement of the needles 10 through the bath 40, is sufficient to effectively allow a high current density to be used causing the metal to be removed from the surfaces of needles 10 in such a fashion that the points and edges remain sharp. The speed of the needles 10 through the bath 40 can be increased and optimized. It is preferred that the bath 40 be circulated in vessel 50 by conventional means such as pumps so that for at least one half of the path of needles 10 through the bath 40, the direction 45 of the flow of bath 40 is 180 degrees opposite to the direction of movement of the needles 10 and carrier 15.

By adjusting the position of the carrier 15 with respect to the top 41 of electropolishing bath 40, or the position of needles 10 with respect to carrier 15, a partial polish of the needles 10, for example, a polish of points 11 may be obtained; or, by mounting the needles 10 in an opposite manner, a polish of proximal suture mounting end 12 may be obtained.

The needles 10 and carrier strip 15 are then optionally moved to an optional rinse tank 60 having rinse bath 65 (not shown) where the needles are rinsed with a bath of fresh water in order to remove any residue from bath 40. Distilled water, deionized water, hot water, reclaimed and recycled industrial water, chilled water, water containing other ingredients including acids, caustics, neutral soaps, or wetting agents, water solution agitated by propeller, oscillator, or ultrasonic vibration, water sprayed, pumped, or otherwise conveyed, or any combinations thereof, may be utilized. It is particularly preferred to use a bath 65 of warm water solution with a small percentage of wetting agent, such as Triton X-100, the bath 65 being ultrasonically agitated, followed by a spray of warm, distilled water rinse.

The needles 10 and strip 15 are then optionally moved to an optional drying vessel 70, wherein the needles 10 and strip 15 are dried by hot air. Cold air, ambient air, compressed air, super heated air, dried air, or air mixed with a solid, liquid or other gas, for the purpose of drying, cleaning or preparing the needle surfaces for coating, may be used in addition to hot air. The air may be delivered by nozzle, orifice, air knife, fan, conduit, or bellows. For example, a jet of fast moving air to remove standing water droplets, followed by fan propelled hot air to dry residual moisture.

Optionally, the carrier 15 and needles 10 are moved through a modular tank area where the needles 10 are optionally dipped into a reservoir, stream or spray of a lubricating coating, for example a silicone solution. The coating is then dried in a conventional manner.

The conventional drive mechanism for the carrier 15 is located at the end of the tank modules. It can be connected to the modular tanks, or stand alone. It may consist of a frame member which supports an adjustable speed drive motor, coupled to a driving sprocket. The sprocket engages the pilot holes 16 of the carrier 15, and pulls the carrier 15 and needles 10 through the entire continuous polishing system. The diameter of this drive sprocket should be sufficiently large to effectively not deform the carrier strip 15.

After polishing and the optional process steps described above, the strip 15 and needles 10 are coiled onto a spool by conventional re-coiling apparatus 100, using a dancer arm to detect loop position.

Figure 3:
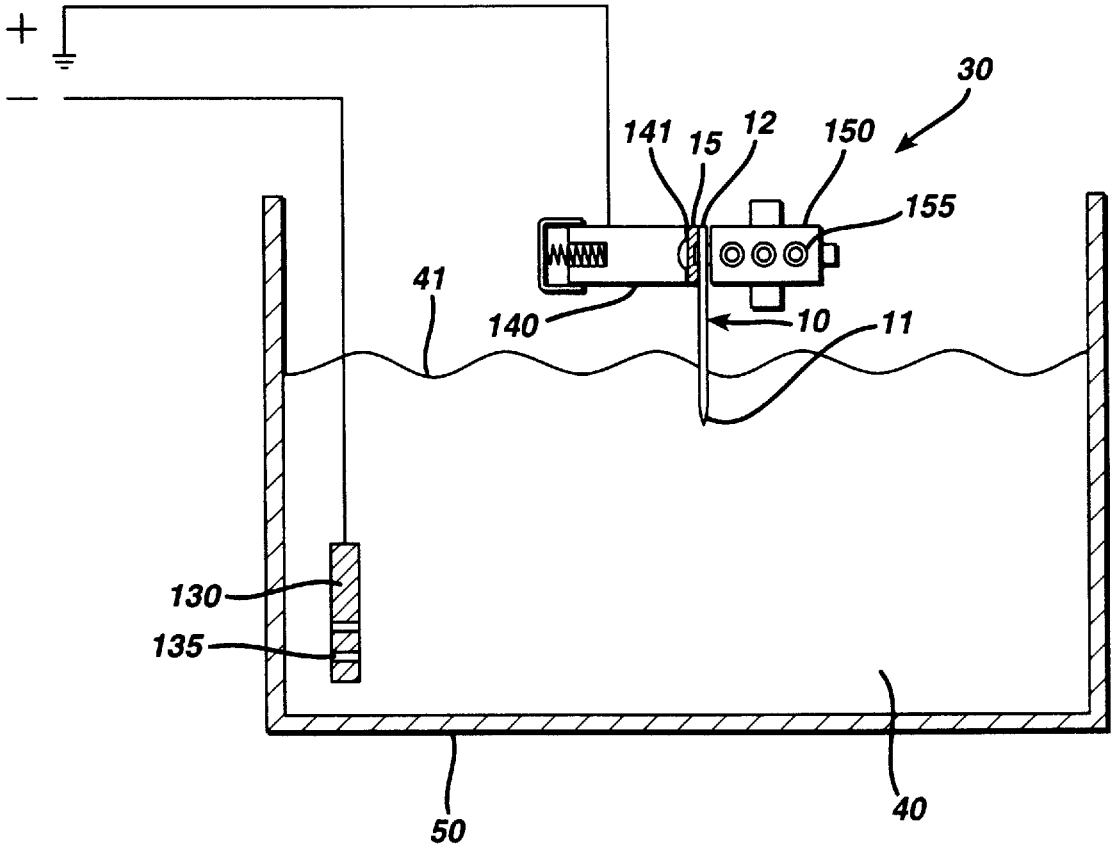
FIG. 3 is a schematic diagram illustrating a latitudinal cross-section of an electropolishing bath apparatus useful in the process of the present invention.
Figure 4:
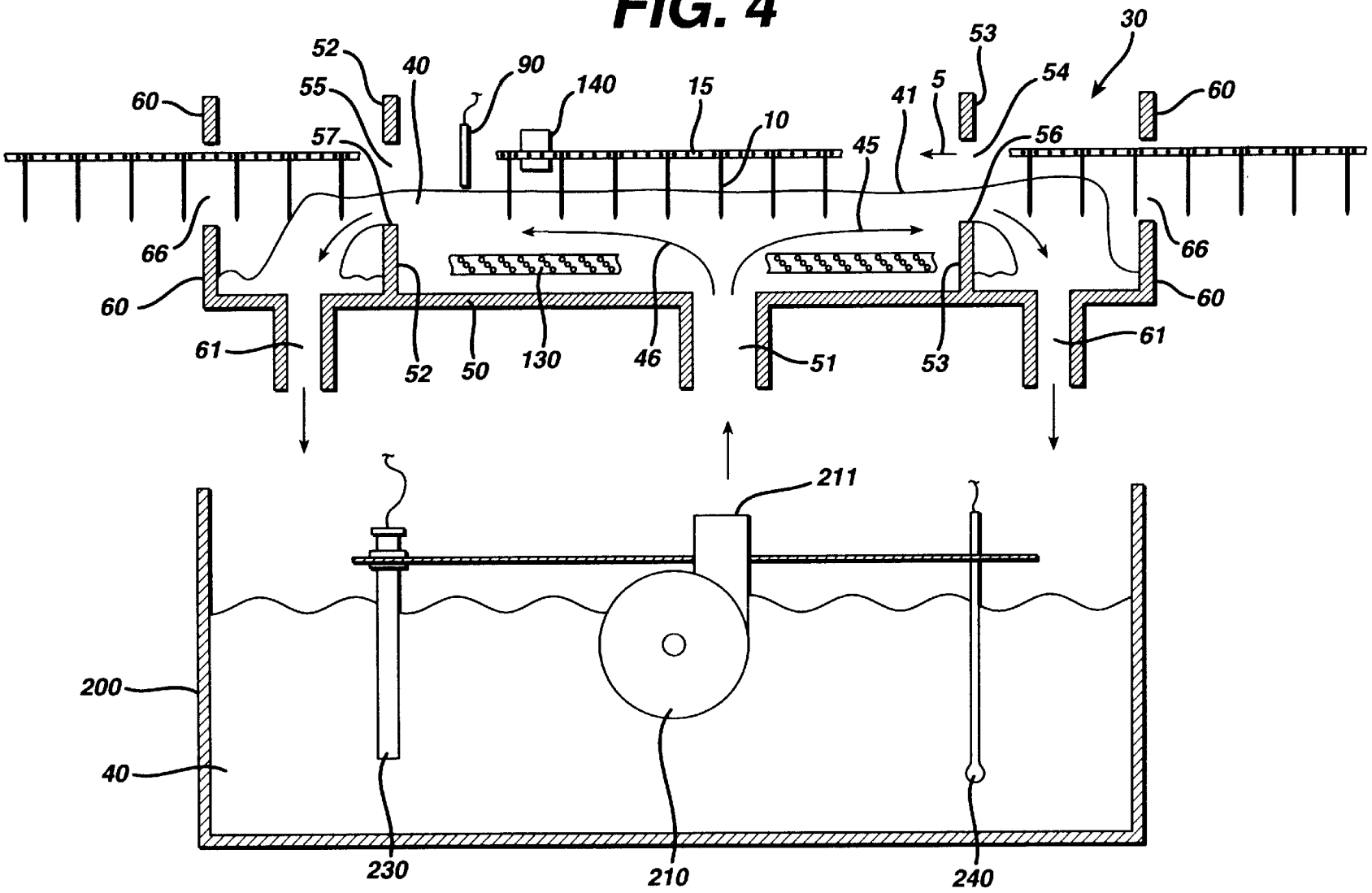
FIG. 4 is a schematic diagram illustrating a longitudinal cross-section of an electropolishing bath apparatus useful in the process of the present invention.

Referring now to FIG. 3, a schematic diagram illustrating a latitudinal cross-section of a polishing bath 40 and electropolishing vessel 50 of an electropolishing apparatus 30 useful in the process of the present invention is illustrated. The apparatus is illustrated in FIG. 4. The vessel 50 is constructed of an electrically insulating material and contains the electropolishing bath 40. A cathode 130 is seen to be immersed in bath 40. The material of construction of the cathode is stainless steel, or an equivalent conventional material, and is located along the length of the polish tank, maintaining approximately a constant distance from the anodic path. If desired multiple cathodes 130 may be placed in vessel 50, e.g., two parallel cathodes 130 running the entire length of vessel 50. Preferably, the cathode 130 contains a plurality of holes 135 along its entire length. The holes 135 are preferably round but may have other geometric shapes including ellipses, squares, rectangles, polygons, combinations thereof and the like. It is believed that openings 135 decrease gas formation during the electropolishing process and improve the efficiency of the process. The cathode 130 is preferably made from a 300 series stainless steel, and most preferably 316L type stainless steel. A needle 10 is seen to have its distal end 11 immersed in the bath 40 while the carrier 15 and the proximal end 12 (or tail) of the needle are above the top of the bath. The carrier 15 is seen to contact the surface 141 of spring biased anodic contact 140. A rotatable carrier guide wheel 150 having pins 155 (tapered or rounded) for engaging pilot holes 16 in the carrier strip 15 for support, is suspended over the vessel 50 to maintain the electrical contact between the strip 15 and the surface 141 of anodic contact 140. The anodic contact 140 is necessarily made of conductive material, such as metal, and more preferably of an acid resistant material, such as stainless steel, due to its close proximity to acid and fumes thereof. It is also a requirement that the anodic contact 140 be made of material which has a suitable low friction characteristic, as the carrier strip 15 is continually in contact with the surface 141 of anodic contact 140 while moving through the electropolishing bath 40. This movement will continuously clean the surface 141 of anodic contact 140 assuring good electrical contact and current flow. A 300 series stainless may be used, although there are many other materials that may be substituted.

FIG. 4 illustrates a longitudinal cross-section of a schematic diagram of an electropolishing bath apparatus 30 useful in the process of the present invention. Electropolishing bath 40 is seen to be contained in vessel 50. Vessel 50 is seen to contain cathode 130. The vessel 50 is seen to have a vertical end pieces 52 and 53 containing openings 54 and 55 for receiving carrier strip 15 and needles 10 mounted thereto. Adjacent to the end pieces 53 and 52 are the overflow containers 60 which have ports 61 for return of the bath 40 to reservoir vessel 200. Containers 60 also have end walls 65 (not shown) having openings 66 (not shown) for passage of the carrier strip 15 and needles 10. Reservoir vessel 200 is mounted preferably directly below the electropolishing bath vessel 50. Contained in the reservoir 200 are a heater 230 and a temperature sensor 240. The temperature of the bath 40 is maintained by sensing in a conventional manner the temperature of the bath 40 in the reservoir 200 and then in a conventional manner controlling heater 230, preferably an electrical resistance heater, such that the temperature range is obtained. Also contained in reservoir 200 and immersed in bath 40 is a submersible pump 210, preferably a positive displacement pump, although other types of conventional pumps, including centrifugal pumps, can be used. In addition, if desired, an externally mounted pump may be utilized. Electropolishing bath apparatus 30 illustrated in FIG. 4 operates in the following manner. The openings 54 and 55 in end pieces 52 and 53 are adjusted such that openings 54 and 55 will give the appropriate bath level based upon the output of bath 40 from pump 210 into inlet port 51 in vessel 50. A level sensor 90 controls the level of the bath such that the desired sections of the needles 10 are electropolished. The level is controlled preferably by adjusting the flow from pump 210. As the carrier 15 and the needles 10 are moving in direction 5 through the electropolish bath 40 in vessel 50, bath 40 is continuously flowing through openings 55 and 54 into overflow containers 60 adjacent to vessel 50 and returned via ports 61 to reservoir 200. In reservoir 200 the bath 40 is heated, and optionally the specific gravity of the bath is maintained, and the bath is then pumped into port 51 of vessel 50 via the discharge port 211 on pump 210. The amperage across the anode and the cathode is maintained within the ranges specified herein. It is noted that the pump 210 directs the bath 40 through entry port 51 into vessel 50 such that half of the flow is directed in direction 45 to a first end receptacle 60 in a flow which is approximately 180° opposed to the direction of movement 5 of the strip 15 for one-half of the length of the tank. For the remaining one-half of the tank, the flow is in a direction 46 parallel to the direction of movement of the needles and strip 15. If desired, entry port 51 could be mounted on one end of vessel 50 such that the flow of bath 40 is opposite to the direction of movement of carrier 15 and needles 10 for the entire path of the carrier 15 and needles 10 through vessel 50 and bath 40. It should be noted that the top 41 of bath 40 is maintained so that it is above the bottoms 56 and 57 of openings 54 and 55. The amount of the surfaces of needles 10 which are polished depends upon the depth of submersion of needles 10 in bath 40, which is controlled by adjusting the level of top 41, the position of carrier 15 or needles 10 with respect to the top 41 or a combination thereof. Although not preferred, strip 15 and the needles 10 may be immersed in their entirety in bath 40 below top 41.

The electropolishing baths of the present invention will typically be conventional aqueous baths having sufficient amounts of conventional electrolytes to effectively function for metal removal, e.g., phosphoric, sulfuric, acetic, glycolic, hydrochloric, combinations thereof and the like. The electrolytes are typically inorganic acid solutions.

The concentrations must be sufficient to provide effective metal removal. The specific gravity will typically range from about 1.300 to about 1.800, more typically about 1.30 to about 1.5, and most preferably about 1.325 to about 1.35.

The temperature of the bath will be sufficient to provide effective metal removal. The temperature will typically be about 130° F. to about 176° F., more typically about 140° F. to about 160° F., and preferably about 147° F. to about 153° F.

The current density used in the electropolishing baths of the present invention will be sufficient to provide for effective metal removal. Typically the current density will range from about 1 to about 35 A/sq.in., more typically about 1 to about 16 A/sq.in., and preferably about 1 to about 15 A/sq.in. for tips, and about 1 to about 3 A/sq.in. for needles bodies.

Multiple polishing baths may be maintained to accomplish the desired polishing characteristics of the point 11 and of the body of the needle 10, and may to some extent, be controlled separately, due to the separate controls of current, temperature, specific gravity, and electrolyte level within each tank module. So that, the polish may be obtained continuously using two or more polishing baths in sequence.

The speed of the needles 10 with respect to the bath 40 of the present invention may affect the degree and efficiency of metal removal and will be sufficient to effectively remove the desired amounts of metal. For example, it may be desirable to move the needle 10 at a speed of about 0.5 inches per second to about 2.0 inches per second, more preferably about 0.78 inches per second to about 2.0 inches per second, and preferably about 1.1 inches per second to about 2.0 inches per second. The velocity of bath 40 in tank 50 will be sufficient to provide for effective metal removal. For example, the velocity may be about 1.0 inches per second to about 40 inches per second, more preferably about 10 to about 40, and preferably about 20 to about 30 inches per second. It is preferred to move the bath in a direction opposite to the direction of movement of the needles, for example greater than 135 degrees and preferably 180 degrees opposite.

Although this invention has been shown and described with respect to detailed embodiments thereof, it will be understood by those skilled in the art that various changes in form and detail thereof may be made without departing from the spirit and scope of the claimed invention.

We claim:

1. A continuous process for electropolishing surgical needles, said process comprising:

mounting a plurality of surgical needles to an electrically conductive carrier means, said needles comprising an elongated member having a distal piercing tip and a proximal suture mounting end;

moving the carrier means and needles, such that at least a section of each of the needles moves along a path in a direction through an electropolishing bath, said bath comprising an aqueous electrolyte and a cathodic electrode and an anodic electrode, wherein the anodic electrode is electrically contacted to the carrier means;

moving the bath in a direction such that the direction of the bath is about 180 degrees opposite to the direction of movement of the needles for at least one-half of the path of the needles through the bath;

passing an electrical current through the needles in the bath;

maintaining the needles in the electropolishing bath for a sufficient residence time at a sufficient temperature and a sufficient current flow to effectively remove metal from the surface of the surgical needles.

2. The process of claim 1 wherein the direction of movement of the bath is about 180 degrees opposite to the direction of movement of the needles for the entire path of the needles through the bath.

3. The process of claim 1 further comprising the step of containing the bath in a nonconductive vessel having first and second opposed ends, wherein the first opposed end comprises an entrance opening for the carrier means and needles and an exit opening at the second opposed end to allow the carrier means and needles to pass through the vessel.

* * * * *